US009435107B2

(12) United States Patent
Rexach et al.

(10) Patent No.: US 9,435,107 B2
(45) Date of Patent: Sep. 6, 2016

(54) SHAPE MEMORY FAUCET

(71) Applicant: Kohler Co., Kohler, WI (US)

(72) Inventors: Rafael Alfredo Rexach, Sheboygan, WI (US); Margaret Cecile Mazz, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 206 days.

(21) Appl. No.: 14/016,721

(22) Filed: Sep. 3, 2013

(65) Prior Publication Data

US 2014/0069511 A1 Mar. 13, 2014

Related U.S. Application Data

(60) Provisional application No. 61/698,444, filed on Sep. 7, 2012.

(51) Int. Cl.
*E03C 1/04* (2006.01)
*B05B 15/08* (2006.01)

(52) U.S. Cl.
CPC ..... *E03C 1/04* (2013.01); *E03C 1/0404* (2013.01); *B05B 15/08* (2013.01); *Y10T 137/0402* (2015.04); *Y10T 137/9464* (2015.04)

(58) Field of Classification Search
CPC ..... Y10T 137/9464; Y10T 137/0402; E03C 1/02; E03C 1/04; E03C 1/0404; B05B 15/08
USPC ..... 137/801
See application file for complete search history.

(56) References Cited

U.S. PATENT DOCUMENTS

| | | | | |
|---|---|---|---|---|
| 2,704,556 A | | 3/1955 | Blish | |
| 4,314,717 A | | 2/1982 | Bjurman | |
| 4,709,715 A | | 12/1987 | Knight | |
| 5,062,456 A | * | 11/1991 | Cooke et al. | 138/125 |
| 5,749,179 A | | 5/1998 | Bohacik | |
| 5,758,690 A | | 6/1998 | Humpert et al. | |

(Continued)

FOREIGN PATENT DOCUMENTS

| | | |
|---|---|---|
| CN | 201988461 U | 9/2011 |
| CN | 202290424 U | 7/2012 |

(Continued)

OTHER PUBLICATIONS

Kockar, Benat. Shape Memory Behavior of Ultrafine Grained NiTi and TiNiPd Shape Memory Alloys. Diss. Texas A&M U, 2007. N.p.: n.p., 2009. Print.*

(Continued)

*Primary Examiner* — Kevin Murphy
*Assistant Examiner* — Richard K Durden
(74) *Attorney, Agent, or Firm* — Foley & Lardner LLP

(57) ABSTRACT

A shape memory faucet has a base configured to be coupled to a surface, a spray head configured to direct a spray of fluid, and a faucet spout disposed between the base and the spray head, the faucet spout comprising a waterway and at least one elongated member formed from a shape memory alloy material. The faucet spout having the elongated member(s) formed from the shape memory alloy material is deformable from an initial shape corresponding to a rest position to a displaced shape corresponding to a deployed position. The elongated member(s) formed from the shape memory alloy material are operable to return the faucet spout to the rest position when released from the deployed position.

14 Claims, 6 Drawing Sheets

(56) References Cited

U.S. PATENT DOCUMENTS

| | | | | |
|---|---|---|---|---|
| 7,090,154 | B2 * | 8/2006 | Herring | 239/569 |
| 7,207,075 | B2 | 4/2007 | Peterson et al. | |
| 7,344,094 | B1 | 3/2008 | Tracy et al. | |
| 7,607,634 | B2 | 10/2009 | Browne et al. | |
| 7,632,361 | B2 | 12/2009 | Johnson et al. | |
| 7,988,064 | B2 | 8/2011 | Spinelli et al. | |
| 2005/0005988 | A1 * | 1/2005 | Pasquet | 138/126 |
| 2008/0121303 | A1 | 5/2008 | Leggitt et al. | |
| 2008/0174110 | A1 | 7/2008 | Olson | |
| 2008/0222853 | A1 | 9/2008 | Zavattieri et al. | |
| 2009/0143844 | A1 * | 6/2009 | Cazzini | 607/104 |
| 2011/0056577 | A1 * | 3/2011 | Ilett | 137/801 |
| 2011/0308835 | A1 * | 12/2011 | Piekny | 174/69 |

FOREIGN PATENT DOCUMENTS

| | | |
|---|---|---|
| DE | 11 58 774 | 12/1963 |
| EP | 1 944 418 | 7/2008 |
| JP | 60-104311 | 6/1985 |
| JP | 08-233126 | 9/1996 |
| JP | 11-332773 | 12/1999 |
| JP | 2006-213033 | 8/2006 |

OTHER PUBLICATIONS

European Search Report for EP Application No. 13183087.9, dated Nov. 29, 2013, 6 pages.

Coldren, Kelly, "KWC America Revolutionizes the Functional Kitchen with the KWC ONO Highflex® Hose Technology", KWC America Inc., Norcross, Ga., Apr. 2008, 1 page.

KWC Benelux, YouTube Video titled, "KWC ONO highflex", published on Nov. 9, 2012, retrieved from the internet at https://www.youtube.com/watch?v=vccqHGOqypw on Oct. 19, 2015, 39 pages of screenshots.

* cited by examiner

SHAPE MEMORY FAUCET

CROSS REFERENCE TO RELATED APPLICATIONS

This application claims priority to U.S. Provisional Application No. 61/698,444, filed on Sep. 7, 2012, which is hereby incorporated by reference in its entirety.

FIELD

The present disclosure relates generally to the field of faucets. More specifically, the present disclosure relates to faucets including an elongated member formed from a shape memory alloy material and disposed within a flexible faucet spout to allow the faucet spout to hold a predetermined initial shape (e.g. a rest position). A user may simply bend the spout to place a spray head in any of a variety of desired (e.g. deployed) positions, after which the shape memory material of the elongated member in the spout returns the spout and spray head to the initial (e.g. rest) position.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

To allow a user to direct a spray of fluid (e.g., water) exiting a faucet to a specific location, a faucet often includes a detachable spray head connected to an extendible/retractable hose. For example, the detachable spray head may be a pull-down faucet spray head connected to an end of a faucet spout. In this configuration, water moves through a hose contained within the faucet spout and exits the faucet through the pull-down faucet spray head. The pull-down faucet spray head may be pulled down a limited distance away from the end of the faucet spout.

In another example, the detachable spray head may be a pull-out faucet spray head. In this configuration, the pull-out faucet spray head and hose are not connected to an end of the faucet spout. Instead, water can be diverted from exiting the faucet through the end of the faucet spout to exiting the faucet through the pull-out faucet spray head. In a conventional pull-out faucet spray head, water typically cannot simultaneously exit through both the end of the faucet spout and the pull-out faucet spray head. The pull-out faucet spray head may be pulled up a limited distance away from its resting position.

In both examples, although detachable spray heads allow the user to direct the spray of water exiting the faucet to a specific location, the detachable spray head can be a challenge to move around a basin (e.g. a sink) due to the range of motion being limited by the hose to which the detachable spray head is connected. Specifically, a length of the hose or a rigidity of the hose may prevent a user from directing the spray to certain locations or bending the detachable spray head at certain angles. Moreover, an internal surface of the hose may accumulate dirt and grime over time while it is extended, and then the contaminants may accumulate within the faucet spout when the hose is retracted, making it difficult to maintain a desired cleanliness of the faucet.

A need exists for improved technology, including technology that may address the above described disadvantages.

SUMMARY

One embodiment of the disclosure relates to a shape memory faucet including a base that connects the faucet to a surface, a spray head that directs a spray of fluid exiting the faucet and a faucet spout disposed between the base and the spray head. The faucet spout includes rods formed from a shape memory alloy material and set into a predetermined initial shape. The rods are capable of deforming to a shape other than the predetermined initial shape when a user exerts a force upon the faucet spout or spray head (e.g. to move the spray head to a deployed position, etc.). Upon releasing the faucet spout or spray head, the rods return to their initial shape and thereby also return the faucet spout and spray head to their initial (e.g. rest) position.

Another embodiment of the disclosure relates to a method of manufacturing a shape memory faucet, the faucet including a base configured to be coupled to a surface, a spray head configured to direct a spray of fluid and a faucet spout disposed between the base and the spray head, and the faucet spout having at least one elongated member disposed adjacent to a waterway. The method includes providing a shape memory alloy for forming the elongated member, inserting the shape memory alloy into a mandrel, the mandrel having dimensions and surface features corresponding to a desired predetermined shape of the elongated member, heating the shape memory alloy and the mandrel to a predetermined temperature in a heat source, the predetermined temperature depending on the shape memory alloy provided, removing the shape memory alloy from the heat source when the predetermined temperature is reached, quenching the shape memory alloy in a fluid, and assembling the elongated member having the predetermined shape into the faucet spout.

Another embodiment of the disclosure relates to a shape memory faucet having a base configured to be coupled to a surface, a spray head configured to direct a spray of fluid, and a faucet spout disposed between the base and the spray head. The faucet spout comprises a waterway and one or more elongated members formed from a shape memory alloy material disposed adjacent to the waterway and set into a predetermined initial shape corresponding to a rest position. The faucet spout having the elongated members formed from the shape memory alloy material is deformable from the initial shape to a displaced shape corresponding to a deployed position, and the elongated members formed from the shape memory alloy material are operable to return the faucet spout to the rest position when released from the deployed position.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The accompanying drawings, which are included to provide further understanding of the invention, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring generally to the figures, one embodiment of the disclosure relates to a shape memory faucet including a base that connects the faucet to a surface (e.g. sink, countertop, cabinet, plumbing appliance, etc.), a spray head that directs a spray of fluid (e.g. water, etc.) exiting the faucet and a faucet spout disposed between the base and the spray head. The faucet spout includes a plurality of members shown by way of example as rods formed from a shape memory alloy material and set into a predetermined initial shape (e.g. corresponding to an initial position of the faucet spout and spray head in a resting position). The rods are capable of deforming to a shape other than the predetermined shape when a user exerts a force upon the faucet spout or spray head, and then returning to their original shape upon being released, so that the faucet spout and spray head return to the rest position, without the use of any brackets, holders, docking stations, retractors or manual repositioning by the user.

Figure 1:
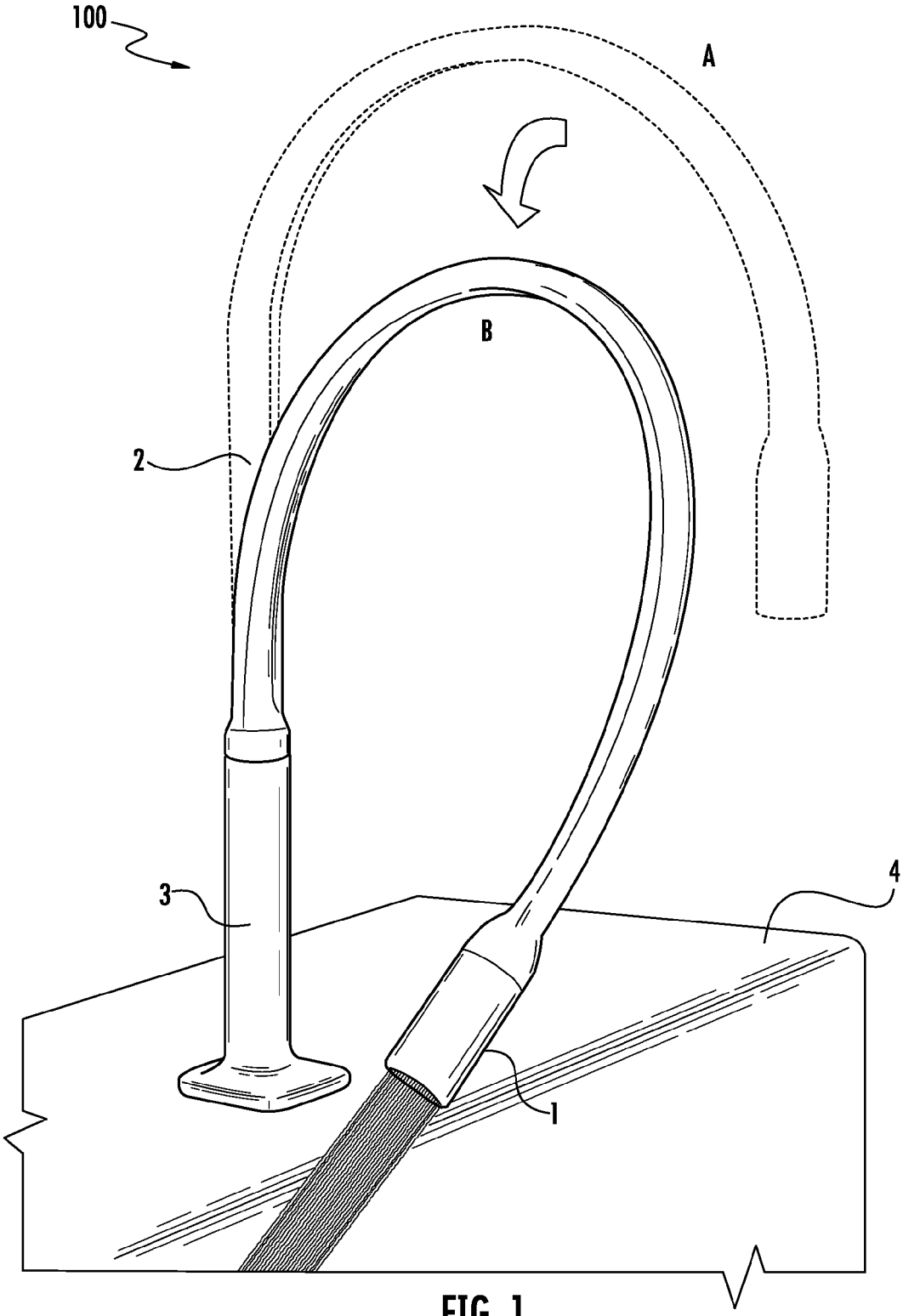
FIG. 1 is an isometric view of a shape memory faucet according to an exemplary embodiment.

Referring to the figures more particularly, as illustrated in FIG. 1, a shape memory faucet 100 includes a spray head 1, a faucet spout 2 and a base 3. The spray head 1 is configured to direct a spray of fluid (e.g., water) exiting a faucet to a desired location. The faucet spout 2 is configured to be bent by a user to move the spray head 1 to any of a wide variety of desired (e.g. deployed) location and positions. The base 3 is configured to secure the faucet spout 2 to a surface 4. The surface 4 may be any surface including, but not limited to, a sink, a bathtub, shower wall, countertop, cabinet, appliance, etc.

Figure 2:
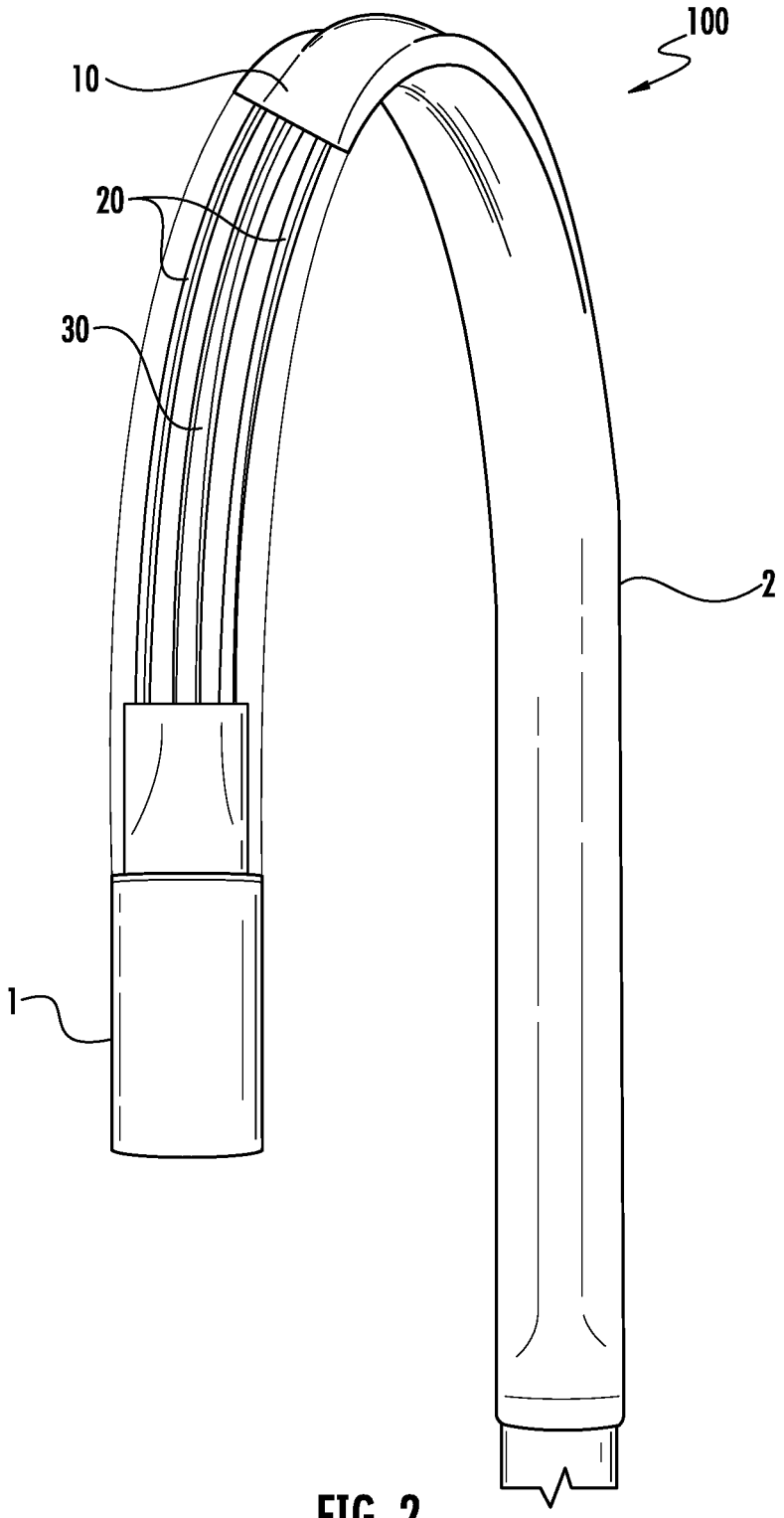
FIG. 2 is an isometric view of a faucet spout of the shape memory faucet according to the exemplary embodiment of FIG. 1.

As illustrated in FIG. 2, in a preferred embodiment, the faucet spout 2 is formed from a flexible tube 10. The flexible tube 10 may be made from a flexible material and manufactured by any suitable process, for example, extrusion, injection molding, co-molding, etc. In a preferred embodiment, the flexible material is a silicone rubber material or another silicone-type material. Using silicone to form the flexible tube 10, which is an outer layer of the faucet spout 2, is presently considered preferable because the applicants believe that silicone is durable and exhibits a texture, color and feel common to other kitchen products. Moreover, the flexible tube 10 may be provided in any color, for example, black, white, gray, red, etc. or any of a variety of aesthetic or designer colors, appearances or designs.

One, or a plurality of shape memory alloy rods 20, preferably, two shape memory alloy rods 20, are disposed within the flexible tube 10. The shape memory alloy rods 20 are preferably parallel to each other with each defining substantially the same initial shape and curvature in the rest position. A waterway 30 is shown disposed in close proximity or adjacent to (shown for example as between each of) the shape memory alloy rods 20 and is operably connected to a valve (not shown) proximate the base 3, and to the spray head 1. The shape memory alloy rods 20 may be affixed at one end to the base 3 and at the other end to the spray head 1. In one embodiment, to provide additional structure, the shape memory alloy rods 20 may be held in place by a suitable flexible material and then co-molded with a soft silicone material. Tubing material associated with the waterway 30 may also provide additional structure (e.g. stiffness, resiliency, etc.). In other embodiments, any number of shape memory alloy rods 20 may be used, such as three, four, five, etc. shape memory alloy rods 20, and disposed in a desirable relationship relative to the waterway 30. Preferably, an even number of shape memory alloys rods 20 are used and configured such that a configuration of shape memory alloy rods 20 on one side of the waterway 30 is symmetrical to a configuration of shape memory alloy rods on the other side of the waterway 30.

In general, a shape memory alloy material is understood to be a pseudoelastic alloy capable of being set in a predetermined initial shape when heated to a transformation temperature. A transformation temperature is determined by the shape memory alloy utilized. When the shape memory alloy is below its transformation temperature (such as in commercial and residential plumbing fixture applications and environments), the shape memory alloy has a low yield strength and can easily be deformed into a new shape (e.g. for moving the spray head from the rest position to the deployed position, etc.) and then returns to its initial shape when the spout or spray head is released (to 'automatically' return from the deployed position to the rest position of its own accord), without further action by the user, and without other mechanisms such as retractors, etc. In other words, the shape memory alloy is generally named as such because the alloy "remembers" the predetermined shape. The shape memory alloy can be deformed from the predetermined shape to a new shape and reverted back to the predetermined initial shape any number of times. In other words, deformation of the predetermined shape is understood to be repeatedly reversible.

Any suitable shape memory alloy may be utilized to form the shape memory alloy rods 20. According to an exemplary embodiment, the shape memory alloy rods 20 are formed from nickel-titanium alloys (NiTi, commonly referred to as Nitinol), copper-aluminum-nickel alloys (CuAlNi) or copper-nickel-beryllium alloys (CuNiBe). Other shape memory alloys that may be used include copper-zinc-aluminum alloys (CuZnAl), iron-manganese-silicon alloys (FeMnSi), or other shape memory alloy. The examples of shape memory alloys are illustrative only and not intended to limit the type of shape memory alloy that can be utilized to form the shape memory alloy rods 20.

Any suitable method may be utilized to form the shape memory alloy rods 20 into a predetermined shape (see, for example, a shape defining a resting position or location A in FIG. 1) corresponding to a predetermined initial shape of the faucet spout 2. For example, known methods include, but are not limited to, vacuum arc remelting, vacuum induction melting, plasma arc melting, induction skull melting, e-beam melting, metal injection molding, powder injection molding and physical vapor deposition.

Figure 3:
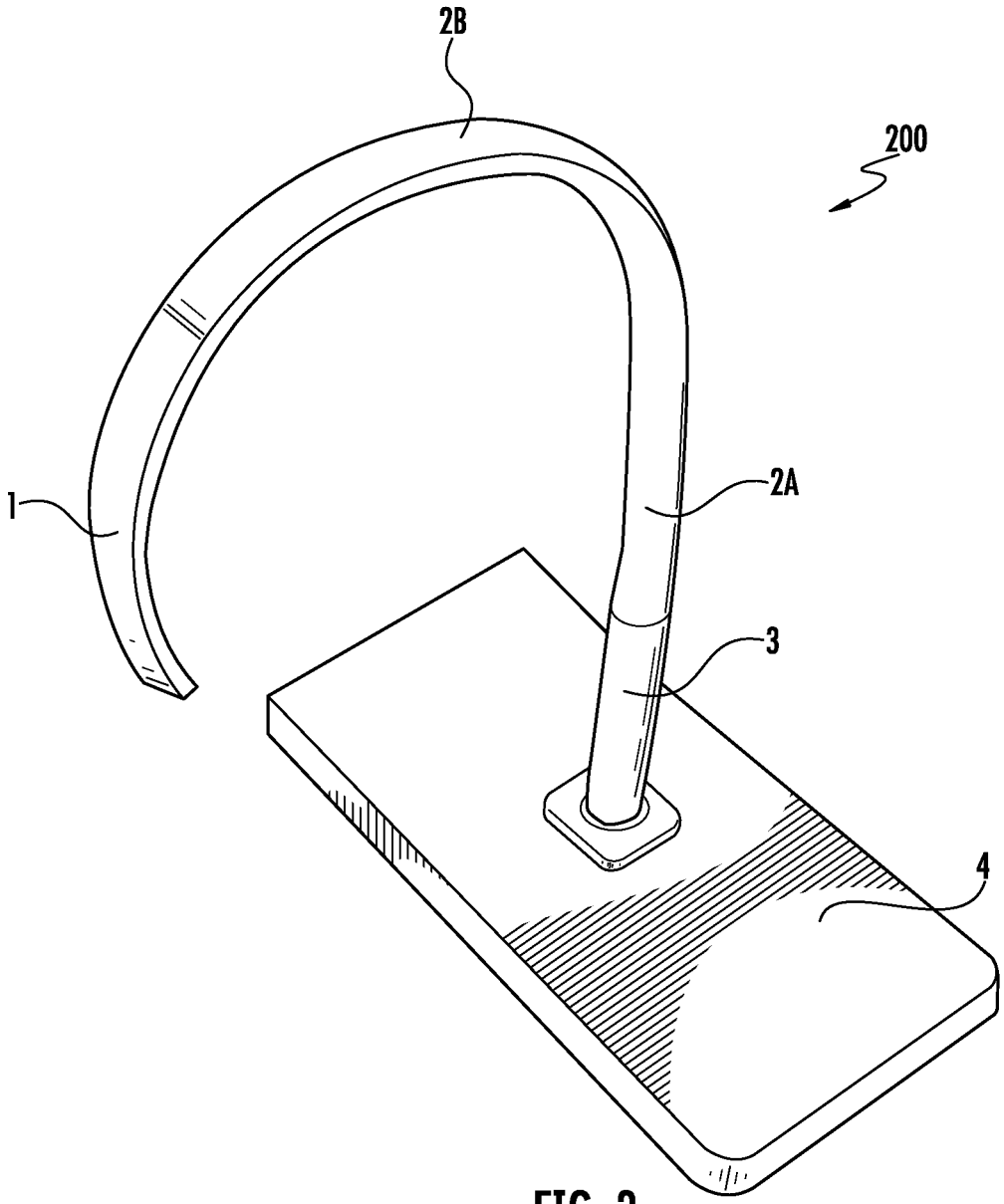
FIG. 3 is a perspective view of the shape memory faucet according to another exemplary embodiment.

In another exemplary embodiment, illustrated in FIG. 3, the faucet spout of a faucet 200 may be formed as having regions of varying flexibility (e.g., portions of the faucet spout may be more rigid, while others may be more flexible). For example, the spout may be formed from a plurality of flexible tubes having different durometer ratings. As illustrated according to one particular exemplary embodiment, for example, a lower portion 2A of the faucet spout that is adjacent to and substantially linearly aligned with the base 3, may be formed from a flexible tube having a first durometer rating. An upper portion 2B of the faucet spout, at least partially defined by a curved part of the faucet spout, may be formed from a flexible tube having a second durometer rating. In one embodiment, the first durometer rating is higher than the second durometer rating, resulting in the lower portion 2A of the faucet spout being more rigid than the upper portion 2B of the faucet spout 2.

In other embodiments, the second durometer rating may be higher than the first durometer rating such that the upper portion 2B is more rigid than the lower portion 2A. In additional embodiments, more than two flexible tubes having different durometer ratings can be used, where all of the flexible tubes have different durometer ratings, all of the flexible tubes 10 have a same durometer rating, or some of the flexible tubes have a different durometer rating from other flexible tubes. Any number of flexible tubes and combinations of durometer ratings can be utilized to form the faucet spout.

Figure 4:
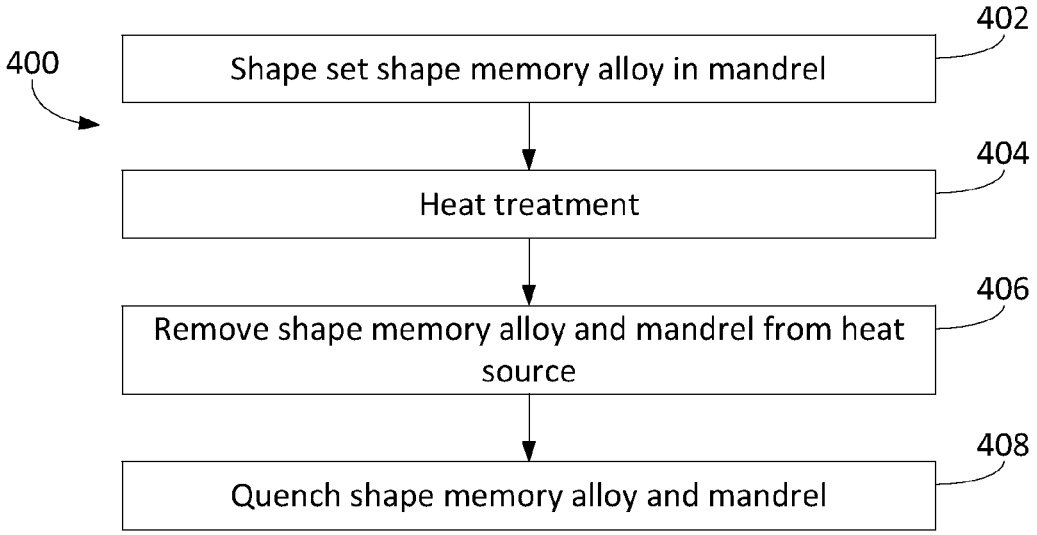
FIG. 4 is an example of a method of manufacturing a shape memory alloy rod disposed within the faucet spout of the shape memory faucet according to the exemplary embodiment of FIG. 2.
Figure 5:
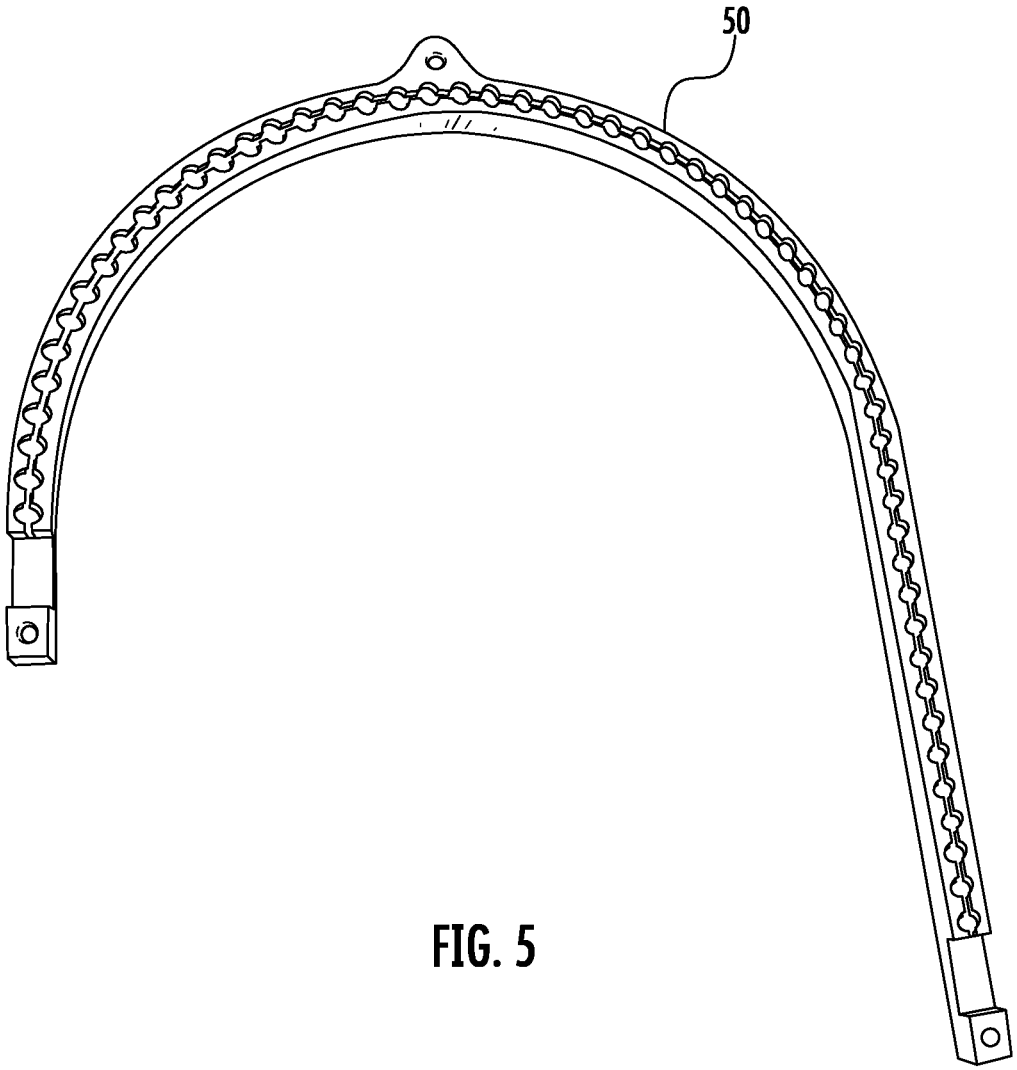
FIG. 5 is a front view of an exemplary embodiment of a mandrel for bending the shape memory alloy rod of FIG. 4 into a desired shape.
Figure 6:
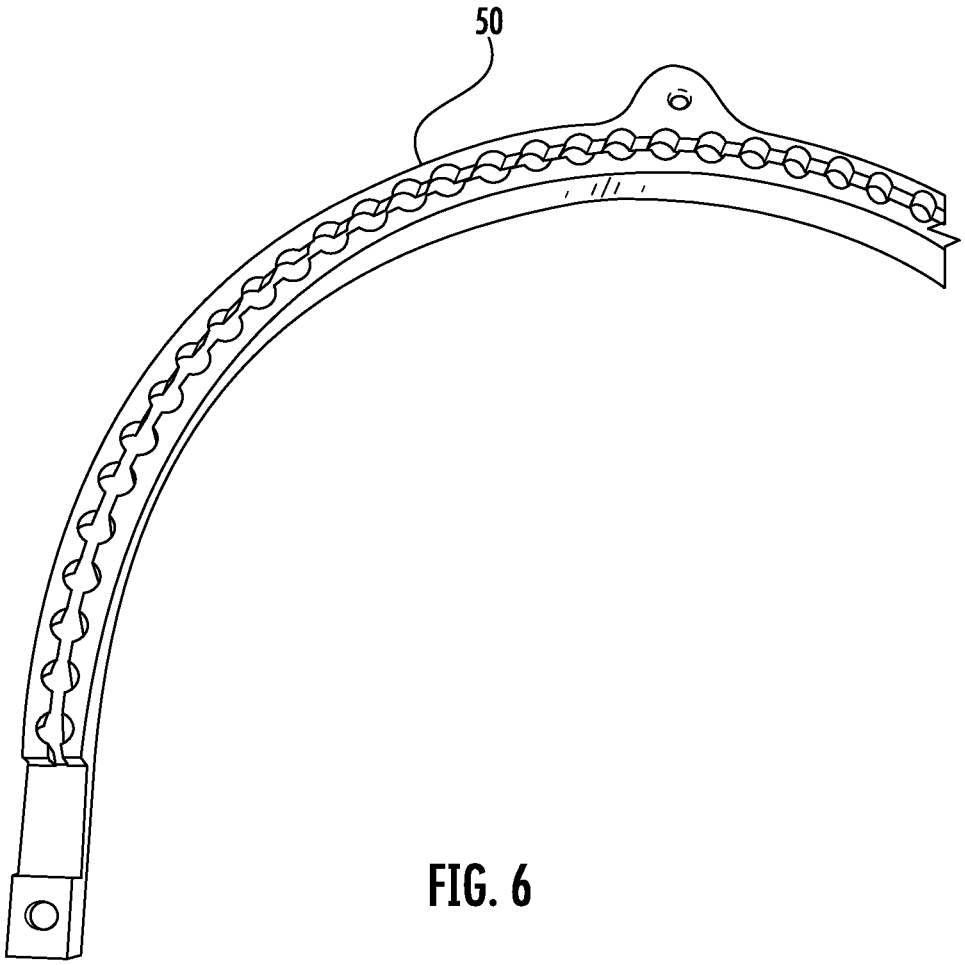
FIG. 6 is a detailed front view of a portion of the mandrel for bending the shape memory alloy rod according to the exemplary embodiment of FIG. 5.

As illustrated in FIG. 4, an exemplary process 400 is provided for forming a shape memory alloy rod 20. First, a shape memory alloy is selected. For example, a copper-aluminum-nickel alloy (CuAlNi) may be selected. The selected shape memory alloy undergoes shape setting to set a predetermined initial shape for the shape memory alloy rod 20 (step 402). Step 402 includes placing the selected shape memory alloy in a mandrel 50 formed in a target predetermined shape (e.g. for application in any of a wide variety of particular faucet styles/designs) (see FIGS. 5 and 6). The dimensions and surface of the mandrel 50 are determined by the target predetermined shape. The mandrel 50 is formed of any suitable material having a higher melting temperature than the selected shape memory alloy. For example, carbon steel may be utilized. The mandrel 50 may be formed in a single piece or the mandrel 50 may be formed in multiple pieces connected by any known conventional method. According to an alternative embodiment, the shape memory alloy may be developed for the particular application.

Next, the mandrel 50 and selected shape memory alloy undergo a heat treatment step (step 404). For example, if CuAlNi is selected as the shape memory alloy, the mandrel 50 and the CuAlNi alloy are heated to a target temperature, for example, approximately 1600° F. or other suitable temperature, in a heat source (not illustrated). However, a temperature to which the mandrel 50 and selected shape memory alloy are heated will vary based on the composition of the selected shape memory alloy. The heat source may be for example, an oven, a furnace, or any other suitable heat source.

Once the mandrel 50 and selected shape memory alloy are heated to the target temperature, the mandrel 50 and selected shape memory alloy are quickly removed from the heat source (step 406) and quenched, for example, in tap water or salt water (to reduce bubbling, etc.) (step 408). After the quenching step, the shape memory alloy rod 20 may be removed from the mandrel 50. Process 400 is repeated until a desired number of shape memory alloy rods 20 are shape-set to the predetermined initial shape for the desired application.

Once the shape memory alloy rods 20 are shape-set, the faucet 100 may be assembled according to an exemplary process. First, the shape memory alloy rods 20 may be inserted into the flexible tubing 10 to form the faucet spout 2. In one embodiment, the spray head 1 may be manufactured separately from the flexible tubing 10. Both the spray head 1 and the flexible tubing 10 may be manufactured, for example, by injection molding or other suitable process. In the illustrated embodiment, the spray head 1 is removeably connected to an end of the faucet spout 2 that is opposite from the base 3. In another embodiment, the spray head 1 and the flexible tubing 10 may be manufactured as one piece, for example, by injection molding or other suitable process. In the illustrated embodiment, spray head 1 and the flexible tubing 10 (i.e. the faucet spout 2) are removeably connected to the base 3.

By providing the faucet 100 with the flexible tubing 10 containing the shape memory alloy rods 20, the faucet 100 allows a user to exert force on the faucet spout 2 and/or spray head 3 to flex (e.g. bend, displace, distort, etc.) the faucet spout 2 and the spray head 1 from a resting position or location A to a desired (e.g. deployed, displaced, etc.) position or location B (see FIG. 1). Upon releasing the spout or spray head, the spout and spray head are returned to the original resting location A as the shape memory alloy rods return to their predetermined initial shape, without the use of a docking bracket, retractor, etc. or manual action by the user.

The shape memory alloy rods 20 are intended to allow the user to freely bend the faucet spout 2 in all directions (i.e. up, down, right, left) in all angles (i.e. 360 degrees) without a range of motion of the faucet spout 2 being limited by a hose or retractor, as is the case in conventional faucets. In addition, the user is not required to manually return the spout or spray head to the initial position. Further, the ability to avoid the use of an extendible/retractable member (e.g. hose, retractor cord, etc.) essentially eliminates the undesirable collection of dirt, grime and other contaminants that collect on the extended member and are then transported into the spout upon retraction, where they can accumulate and create unsanitary conditions that are difficult to effectively clean.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the faucets as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shape memory faucet, comprising:

a base configured to be coupled to a surface;

a spray head configured to direct a spray of fluid; and a faucet spout disposed between the base and the spray head, the faucet spout comprising a waterway and at least one elongated member formed from a shape memory alloy material disposed adjacent to the waterway, wherein the at least one elongated member formed from the shape memory alloy material is configured to deform from an initial shape to a displaced shape when a force is exerted upon the faucet spout or the spray head, maintain the displaced shape, and automatically return from the displaced shape to substantially the initial shape when released.

2. The faucet of claim 1, wherein the faucet spout further comprises a plurality of elongated members formed from shape memory alloy material.

3. The faucet of claim 2, wherein the plurality of elongated members are substantially parallel and arranged symmetrically relative to the waterway.

4. The faucet of claim 1, wherein deformation of the at least one elongated member from the initial shape to the displaced shape is repeatedly reversible.

5. The faucet of claim 1, wherein the shape memory alloy material comprises a nickel-titanium alloy.

6. The faucet of claim 1, wherein the shape memory alloy material comprises a copper-aluminum-nickel alloy.

7. The faucet of claim 1, wherein the shape memory alloy material comprises a copper-nickel-beryllium alloy.

8. The faucet of claim 1, wherein the faucet spout is configured to move in any direction about a central axis of the base.

9. The faucet of claim 1, wherein the faucet spout is configured to bend at any angle about a central axis of the base.

10. The faucet of claim 1, wherein a proximal end of the at least one elongated member is affixed to the base and a distal end of the least one elongated member is affixed to the spray head.

11. The faucet of claim 1, wherein the faucet spout has a length extending from the base to the spray head, and wherein the length of the faucet spout remains constant when the at least one elongated member is deformed from the initial shape to the displaced shape.

12. The faucet of claim 1, wherein the faucet spout further comprises an outermost layer disposed about the waterway and the at least one elongated member, the outermost layer formed of at least one flexible material.

13. The faucet of claim 12, wherein the outermost layer of the faucet spout is formed of a plurality of flexible materials, and wherein a proximal portion of the outermost layer, proximal to the base, is formed of a first flexible material, and a distal portion of the outermost layer, distal to the base, is formed of a second flexible material, the first flexible material having a higher durometer rating than the second flexible material.

14. The faucet of claim 12, wherein the outermost layer of the faucet spout comprises a silicone material.

* * * * *